US005501210A

United States Patent [19]

Van Hoogmoed

[11] Patent Number: 5,501,210

[45] Date of Patent: Mar. 26, 1996

[54] PORTABLE PROPANE COOKING TRAILER

[76] Inventor: Andrew P. Van Hoogmoed, 1216 Persimmon Way, Merced, Calif. 95340

[21] Appl. No.: 445,514

[22] Filed: May 22, 1995

[51] Int. Cl.[6] ..... F24C 1/16

[52] U.S. Cl. ..... 126/276; 126/19.5; 126/25 R; 126/289; 296/181; 296/24.1

[58] Field of Search ..... 126/276, 19.5, 126/25 R, 289; 99/357, 339, 427, 446, 443 L; 296/22, 203, 181, 24.1

[56] References Cited

U.S. PATENT DOCUMENTS

| | | | |
|---|---|---|---|
| D. 253,695 | 12/1979 | Simmons . | |
| D. 334,687 | 4/1993 | Gongwer . | |
| 1,375,121 | 4/1921 | Swartzbaugh . | |
| 2,862,758 | 12/1958 | Robertson | 126/276 |
| 3,073,646 | 1/1963 | Garrison . | |
| 3,696,803 | 10/1972 | Holloway, Jr. | 126/25 R X |
| 3,721,178 | 3/1973 | Szabrak et al. | 99/386 |
| 4,086,849 | 5/1978 | Simmons . | |
| 4,108,055 | 8/1978 | Simmons . | |
| 4,601,509 | 7/1986 | Ellis, Sr. | 296/22 |
| 4,757,756 | 7/1988 | Van Marr | 126/276 X |
| 4,842,316 | 6/1989 | Lerma, Jr. et al. . | |
| 4,848,316 | 7/1989 | Beller . | |
| 5,031,602 | 7/1991 | Vick | 126/25 R X |
| 5,076,258 | 12/1991 | Gongwer | 126/276 X |
| 5,184,599 | 2/1993 | Stuart | 126/25 R |
| 5,193,878 | 3/1993 | Weaver | 296/26 |
| 5,255,664 | 10/1993 | Gurliacci | 126/25 R X |
| 5,383,703 | 1/1995 | Irvine, III | 296/24.1 X |

*Primary Examiner*—Larry Jones
*Attorney, Agent, or Firm*—Richard C. Litman

[57] ABSTRACT

A frame having ground-engaging wheels and a hitch for attaching to a towing vehicle supports a pair of cooking elements, disposed back-to-back, a first pair being located at the forward portion of the frame, and a second pair disposed at the after portion of the frame. A large storage compartment including horizontal closures is interposed between the fore and aft cooking element pairs. A large fuel cylinder, connected to the supply lines of the cooking elements by flexible hose, is mounted on a wheeled gurney. The gurney is demountably secured to the tang of the frame when the apparatus is being transported. Once the apparatus is situated, the gurney provides for removal of the cylinder to a safe area.

16 Claims, 3 Drawing Sheets

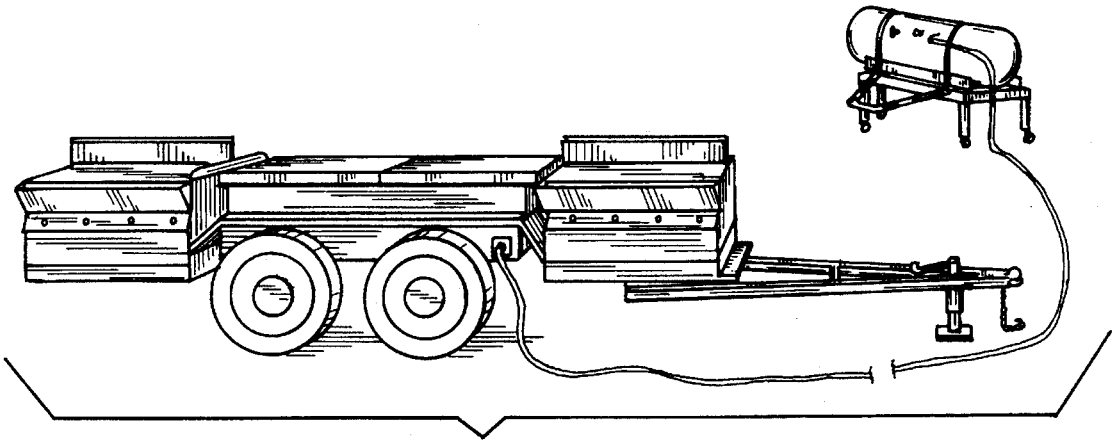
FIG. 4
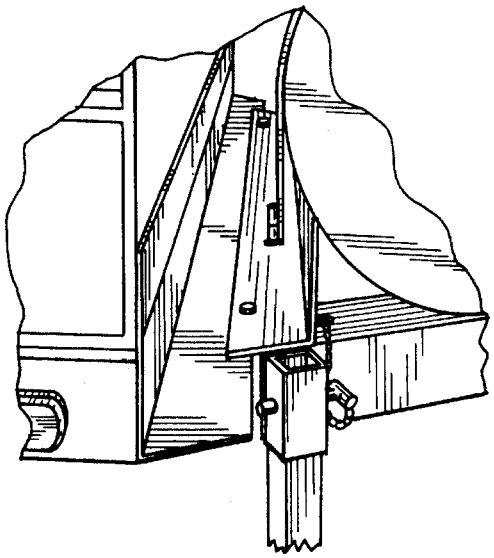
FIG. 6
FIG. 7
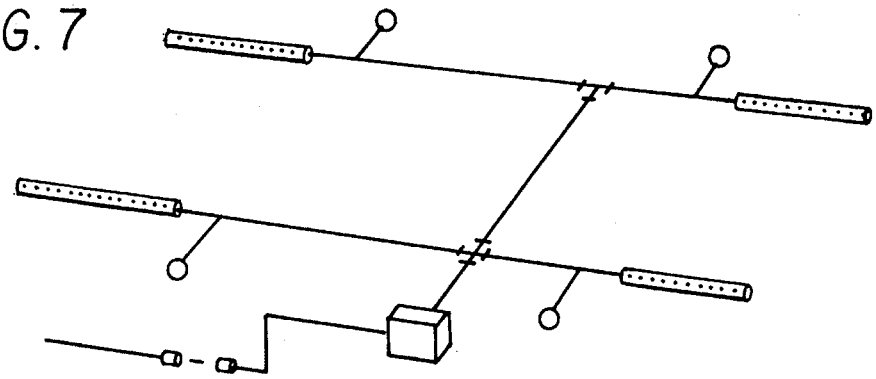

PORTABLE PROPANE COOKING TRAILER

BACKGROUND OF THE INVENTION

1. Field of the Invention

This invention relates to cooking apparatuses. More specifically, the present invention relates to a mobile cooking apparatus with a separable fuel supply.

2. Description of the Prior Art

Food is a universal focal point for many public events. Many of these events occur in areas without adequate catering accommodations. Typically, utilities are scarce, if available at all, rendering food storage and preparation problematic. A need exists for convenient, portable, self contained cooking apparatuses suitable for safely storing and preparing food for large numbers of people.

Several types of portable propane cooking trailers are described in the literature. For example, U.S. Pat. No. Des. 253,695, issued Dec. 18, 1979, and U.S. Pat. No. 4,086,849, issued May 2, 1978, to James A. Simmons, show a mobile broiler. The wheeled apparatus is box-shaped and has a cover which slides over the top surface. The cover may be slid away from the apparatus to expose the upper surface and form an adjacent shelf. The shelf includes a leg for support when the shelf is extended. The upper surface of the apparatus has a grill disposed rearwardly and a storage compartment disposed forwardly. The apparatus also includes a horizontal shelf extending from each lateral side.

U.S. Pat. No. Des. 334,687, issued Apr. 13, 1993, to Dean Gongwer, shows a mobile food cooking trailer. The wheeled apparatus appears to include a small box-shaped member stacked on top of a large box-shaped member. The lateral sides of the large member appear to include a plurality of storage compartments. The lateral sides of the small member and the rear and front sides of the large member each appear to include singular compartments. Each storage compartment includes upwardly swinging closures.

U.S. Pat. No. 1,375,121, issued Apr. 19, 1921, to Charles E. Swartzbaugh, describes a food conveyer. The wheeled device is box-shaped. The device includes a rear storage compartment and a forward stove. Each portion is concealed by a hinged closure. The storage compartment is segregated into two storage wells, each surrounded by insulation. The stove includes a plurality of heating elements.

U.S. Pat. No. 3,073,646, issued Jan. 15, 1963, to Eugene P. Garrison, discloses a kitchen trailer. The wheeled device is box-shaped. The top surface is reserved for luggage storage. The lateral and rear sides each have double closures that close toward each other. A gas stove is mounted on an extensible shelf. The rear closures open to permit extending the shelf to use the stove. A gas cylinder is mounted permanently to the tang of the trailer hitch. A flexible hose connects the stove and cylinder.

U.S. Pat. No. 4,108,055, issued Aug. 22, 1978, to James Simmons, describes a mobile broiler rotisserie apparatus. The box-shaped, wheeled apparatus includes a closure, hinged at a lateral side, that opens upwardly. A shelf extends laterally from the side opposite the hinges for the closure. The closure conceals a grill. A rotisserie spit extends the entire length of the apparatus above the grill.

U.S. Pat. No. 4,842,316, issued Jun. 27, 1989, to Demetrio Lerma, Jr. et al., describes a picnic trailer apparatus. The wheeled apparatus is T-shaped in the top plan view. The top of the T includes the axle with the wheels attached to either end. A stove is disposed in one portion of the top of the T and a grill is disposed in the other portion. Gas cylinders are shown mounted adjacent to the stove. The stem of the T includes a canopy having two, laterally hinged sections that open outwardly. A shelf is laterally hinged to the stem. The shelf may be rotated into a generally horizontal position. Additionally, benches are laterally hinged to the stem. The benches may be folded down into a generally horizontal position.

U.S. Pat. No. 4,848,316, issued Jul. 18, 1989, to Frank W. Beller, describes a trailer adapter for cooking devices. The device includes a box-shaped container having an open top side. The container is supported by a network of interconnected structural members pivotally mounted on an axle. A gas grill is mounted in the container. A gas cylinder is mounted permanently to the tang of the trailer hitch. A flexible hose connects the cylinder to the stove.

Although the above address the need for convenient, portable, self contained cooking apparatuses, none fulfill the need in the manner the present invention. None of the above inventions provides for removing the fuel supply from the cooking area or for a safe arrangement of multiple cooking elements.

None of the above references, taken alone or in combination, are seen as teaching or suggesting the presently claimed portable propane cooking trailer.

SUMMARY OF THE INVENTION

The present invention uniquely advances over the prior art. The invention includes a frame having ground-engaging wheels and a hitch for attaching to a vehicle.

Two pairs of cooking elements are mounted on the frame. Each pair of cooking elements are disposed back-to-back. A pair are disposed in the forward portion of the frame. A second pair are disposed in the after portion of the frame.

A large storage compartment is interposed between the fore and aft cooking element pairs. Two horizontal closures, one having a fore hinge and the other having an aft hinge, close toward each other and conceal the storage compartment. The closures, when closed, present a working surface.

A large fuel cylinder is mounted on a wheeled gurney. The gurney provides for removal of the fuel cylinder to a safe area. The gurney demountably secures to the tang of the frame for transporting the cooking apparatus to various locations. A flexible hose conducts fuel from the cylinder to the supply lines for the cooking elements.

In consideration of the above, an object of the invention is to provide a portable cooking apparatus mounted on a frame having ground engaging wheels and a hitch for attaching to a vehicle.

Another object of the invention is to provide a portable cooking apparatus having multiple cooking surfaces.

A further object of the invention is to provide a portable cooking apparatus including a fuel source which easily may be remotely located.

An additional object of the invention is to provide for a portable cooking apparatus configured to reduce potential for injury when being used for preparing food for great numbers of people. Yet another object of the invention is to provide for improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

FIG. 4 is an environmental perspective of the invention with the fuel cylinder remotely located.

FIG. 6 is a partial top side perspective of the fuel cylinder mounted on the frame tang.

FIG. 7 is a partial top side detail view showing the gurney mounted on the frame.

Similar reference characters denote corresponding features of the invention consistently throughout the attached drawings.

DETAILED DESCRIPTION OF THE PREFERRED EMBODIMENT

Figure 1:
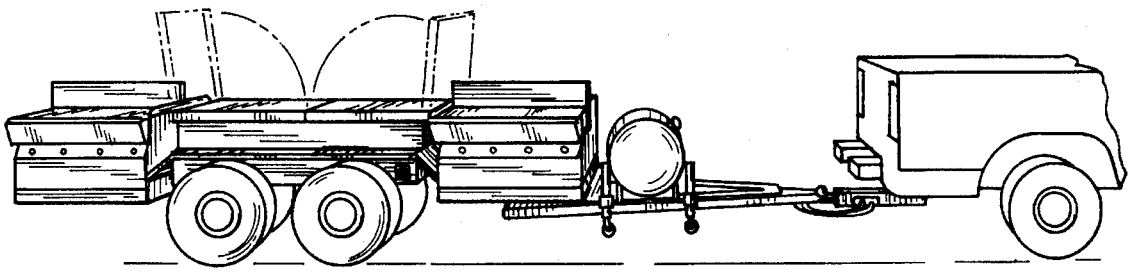
FIG. 1 is an environmental perspective view of the invention hitched to a vehicle.

Referring to FIG. 1, the invention is shown hitched to a vehicle. The invention includes a frame 10 rotatably mounted on ground-engaging wheels 12. Two sets of wheels 12 are preferred, however, any number will suffice. The frame includes a tang 14 and a hitch 16. The hitch 16 may be any conventional hitch commonly used for attaching trailers to vehicles.

Figure 2:
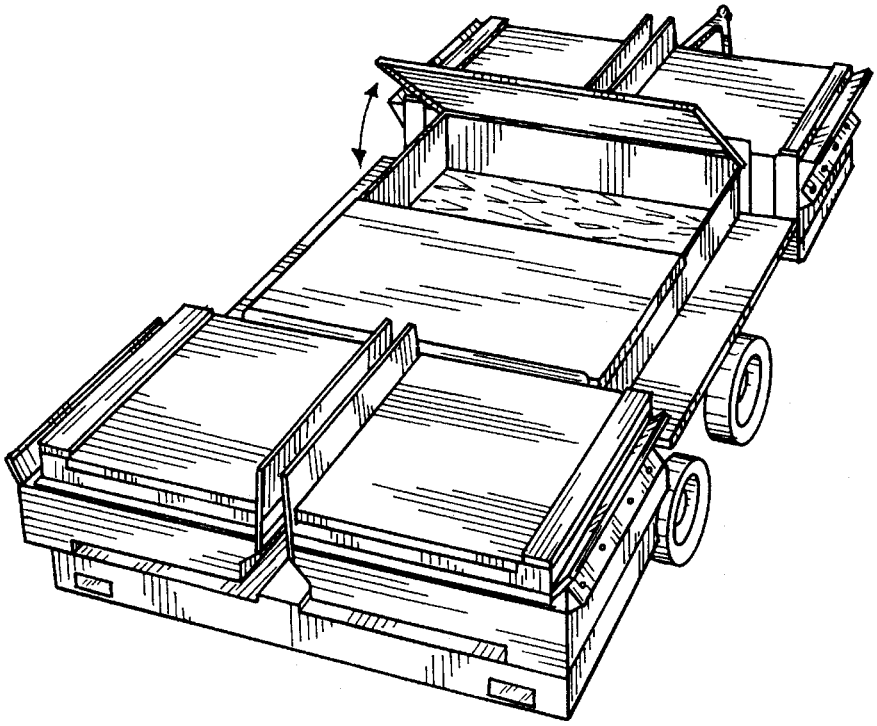
FIG. 2 is top rear perspective view of the invention.

Referring to FIG. 2, the preferred embodiment of the invention includes four cooking elements 18 mounted on the frame 10. The cooking elements 18 are preferably propane burning elements. However, the invention may utilize any equivalent fuel. A pair of cooking elements 18 are disposed back-to-back in the forward portion 20 of the frame 10. A second pair of cooking elements 18 are similarly disposed in the after portion 22 of the frame 10. Configuring the cooking elements 18 back-to-back provides for less crowded cooking conditions. Similarly, separating the two pairs of cooking elements 18 also allows more space between cooking areas. Less crowded cooking areas decrease the potential for injurious errors.

A large storage compartment 24 is interposed between the fore and aft cooking element pairs. Cook ware, utensils, dishes, cutlery, foodstuffs and other items may be securely stowed in the compartment 24. The compartment 24 includes horizontal closures 26 and 28. The closures 26 and 28 may include weather stripping (not shown) to safekeep the stowed items from the elements. The closure 26 has a hinge 30 disposed at the forward edge of the storage compartment 24. The closure 28 has a hinge 32 disposed at the after edge of the storage compartment 24. The closures 26 and 28 close toward each other to conceal the storage compartment 24. When the closures 26 and 28 are closed, they form a horizontal working surface 29. The working surface 29 accommodates food preparation and service. Ideally, the working surface 29 should be constructed from a heat resistant material which can withstand burning pots. The working surface 29 should also be tough enough to resist cuts from forks and knives.

Figure 3:
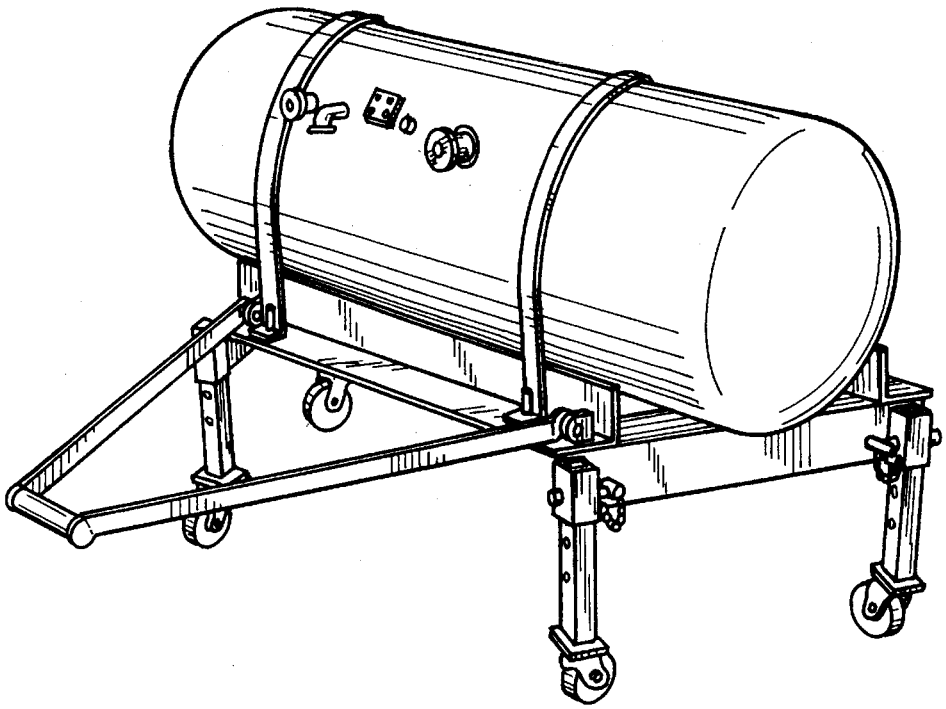
FIG. 3 is a top front perspective of the fuel cylinder gurney.

Referring to FIG. 3, the invention includes a large fuel cylinder 34. The fuel cylinder 34 is mounted on a gurney 36. Preferably, the gurney 36 includes four leg sleeves 38 in which legs 40 are received. Any number of legs 40 appropriate to carry out the invention will suffice. Each leg 40 has a wheel 42 rotatably mounted thereto. The legs 40 of the gurney 36 are individually adjustable. Each leg sleeve 38 has a transversely disposed throughbore 44. Each leg 40 has a vertical array of transversely disposed throughbores 46. Once any throughbore 46 in a leg 40 is in registration with the throughbore 44 in the concomitant leg sleeve 38, a pin 48 is received therethrough, fixing the leg 40 relative to the leg sleeve 38. To increase leg length, the pin 48 is removed from the throughbores 44 and 46, the leg is translated relative to the leg sleeve 38 such that the attached wheel 42 is disposed farther from the gurney 36, then the pin 48 is replaced through throughbore 44 of the leg sleeve 38 and a higher throughbore 46 of the leg 40.

Referring to FIG. 4, the gurney 36 permits the fuel cylinder 34 to be removed to a safe area. Remote location of the fuel cylinder 34 decreases the potential for explosions due to excessive cooking element heat, grease fires or other hazards.

Figure 5:
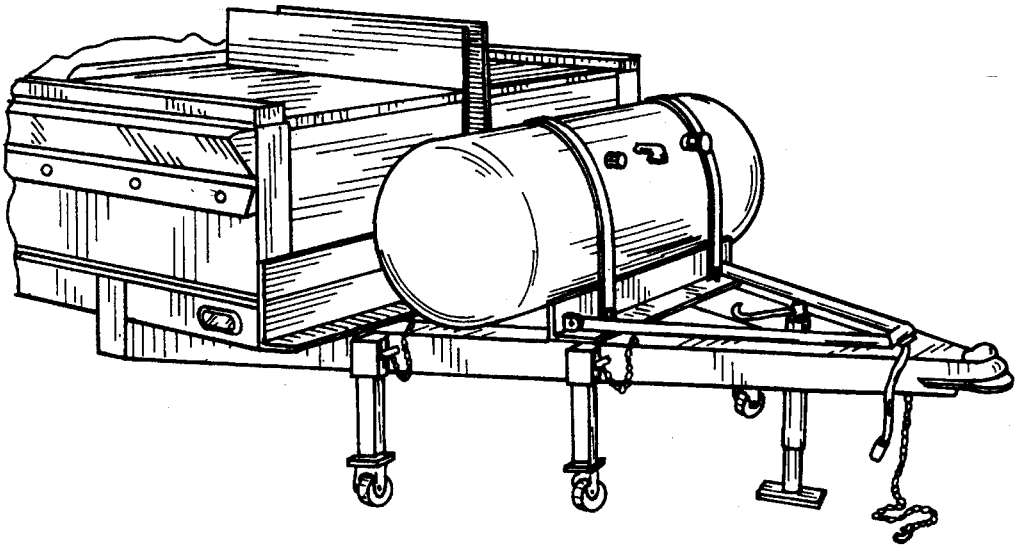
FIG. 5 is a schematic of the fuel supply lines for carrying out the invention.

Referring also to FIG. 5, a long, flexible hose 50 conducts fuel from the fuel cylinder 34 to the cooking elements 18. The hose 50 includes a coupling 54 which sealingly mates with the coupling 56 of the main fuel line 58. Supply lines 63 extend from the regulator 52 to the cooking elements 18. The cooking elements 18 each include a shutoff valve 64 for controlling fuel supply thereto. Each cooking element 18 also includes at least one adjustment valve 62 for controlling the temperature of various portions of the cooking surfaces thereof.

Referring to FIGS. 6 and 7, the gurney 36 demountably secures to the tang 14 of the frame 10. The gurney 36 is shown bolted to the tang 14 with conventional threaded fasteners 52, however, any equivalent means will suffice. The gurney 36 should be securely mounted to avoid coming lose and separating from the frame 10 due to ordinary jostling during transportation.

The present invention is not intended to be limited to the sole embodiment described above, but to encompass any and all embodiments within the scope of the following claims.

I claim:

1. A portable cooking apparatus comprising:

a frame including ground-engaging wheels and a hitch;

at least one cooking element mounted on said frame, said at least one cooking element being a fuel-burning element;

a gurney including ground engaging wheels;

a fuel cylinder mounted on said gurney;

a conduit providing fluid communication between each said at least one cooking element and said fuel cylinder; and mounting means for demountably fixing said gurney to said frame.

2. The portable cooking apparatus as recited in claim 1, further including a storage compartment mounted on said frame.

3. The portable cooking apparatus as recited in claim 2, said storage compartment including at least one horizontal closure, each said one horizontal closure including a hinge interposed between said storage compartment and said at least one horizontal closure.

4. The portable cooking apparatus as recited in claim 3, wherein said at least one horizontal closure is constructed from heat-resistant material.

5. The portable cooking apparatus as recited in claim 3, wherein said at least one horizontal closure is constructed from cut-resistant material.

6. The portable cooking apparatus as recited in claim 1, said at least one cooking element having a front and a back;

there being at least one pair of said at least one cooking elements mounted on said frame having said backs of each of said at least one cooking elements proximately disposed.

7. The portable cooking apparatus as recited in claim 6, further including a storage compartment mounted on said frame interposed between two of said at least one pair of cooking elements.

8. The portable cooking apparatus as recited in claim 7, said storage compartment including at least one horizontal closure, each said one horizontal closure including a hinge interposed between said storage compartment and said at least one horizontal closure.

9. The portable cooking apparatus as recited in claim 7, wherein said at least one horizontal closure is constructed from heat-resistant material.

10. The portable cooking apparatus as recited in claim 7, wherein said at least one horizontal closure is constructed from cut-resistant material.

11. The portable cooking apparatus as recited in claim 1, said mounting means for demountably fixing said gurney to said frame including:

at least one first vertical throughbore disposed in said gurney;

a second vertical throughbore disposed in said tang similarly sized and in registration with each said at least one first vertical throughbore disposed in said gurney;

a threaded fasteners received in each said throughbore disposed in said gurney and said tang; and a threaded nut interengaging each said threaded fastener.

12. A portable cooking apparatus comprising:

a frame including ground-engaging wheels and a hitch;

two cooking elements, said cooking elements being fuel-burning, each cooking element having a front and a back, said two cooking elements being disposed having said backs of each proximately disposed and forming a pair of cooking elements, two said pairs of cooking elements being mounted on said frame;

a storage compartment mounted on said frame interposed between said two pairs of cooking elements;

a gurney including ground engaging wheels;

a fuel cylinder mounted on said gurney;

a conduit providing fluid communication between each said at least one cooking element and said fuel cylinder; and mounting means for demountably fixing said gurney to said frame.

13. The portable cooking apparatus as recited in claim 12, said mounting means for demountably fixing said gurney to said frame including:

at least one first vertical throughbore disposed in said gurney;

a second vertical throughbore disposed in said tang similarly sized and in registration with each said at least one first vertical throughbore disposed in said gurney;

a threaded fasteners received in each said throughbore disposed in said gurney and said tang; and a threaded nut interengaging each said threaded fastener.

14. The portable cooking apparatus as recited in claim 12, said storage compartment including at least one horizontal closure, each said one horizontal closure including a hinge interposed between said storage compartment and said at least one horizontal closure.

15. The portable cooking apparatus as recited in claim 14, wherein said at least one horizontal closure is constructed from heat-resistant material.

16. The portable cooking apparatus as recited in claim 14, wherein said at least one horizontal closure is constructed from cut-resistant material.

* * * * *